United States Patent [19]

Yamamoto

[11] Patent Number: 4,734,744

[45] Date of Patent: Mar. 29, 1988

[54] JAM DETECTOR FOR INTERMEDIATE TRAY OF A COPYING MACHINE

[75] Inventor: Kazushi Yamamoto, Osaka, Japan

[73] Assignee: Sharp Kabushiki Kaisha, Osaka, Japan

[21] Appl. No.: 13,909

[22] Filed: Feb. 12, 1987

[30] Foreign Application Priority Data

Feb. 20, 1986 [JP] Japan ..... 61-36038

[51] Int. Cl.[4] ..... G03G 15/00

[52] U.S. Cl. ..... 355/3 SH; 355/14 R; 355/24

[58] Field of Search ..... 355/3 R, 14 R, 14 CU, 355/3 SH, 14 SH, 23, 24, 25

[56] References Cited

U.S. PATENT DOCUMENTS 4,190,354 2/1980 Smith et al. ..... 355/24 X
4,272,180 6/1981 Satomi et al. ..... 355/24 X
4,568,172 2/1986 Acquaviva ..... 355/3 SH X
4,580,890 4/1986 Sugizaki et al. ..... 355/14 SH
4,589,765 5/1986 Perun et al. ..... 355/3 SH
4,639,120 1/1987 Matsura ..... 355/24 X

*Primary Examiner*—A. C. Prescott
*Attorney, Agent, or Firm*—Flehr, Hohbach, Test, Albritton & Herbert

[57] ABSTRACT

A jam detector for a copying machine includes an optical system with a light emitting element and a light receiving element placed above an intermediate tray for temporarily supporting copy paper after one of its sides has been processed until it is transported away to be processed for the second time. The optical system passes a light beam along the entire length of the tray in the direction of motion of the paper such that the beam is obstructed whenever a sheet is dropped from above into the tray and the jam is detected if the beam is not obstructed at regular intervals.

8 Claims, 5 Drawing Figures

JAM DETECTOR FOR INTERMEDIATE TRAY OF A COPYING MACHINE

BACKGROUND OF THE INVENTION

This invention relates to a device for detecting a jam in the neighborhood of an intermediate tray which is provided in a copying machine for temporarily supporting the copy paper after copying has been finsihed on one side thereof and until it is transported back again to the paper supplying section of the copying machine when it is operated in the two-side copying, composite copying or other multiple copying mode.

The operation of a copying machine capable of automatic two-side copying or composite copying is explained first by way of FIG. 3. Copy paper is supplied from one of paper cassettes 1 and passed through paper feeder rollers 2 and between a photosensitive drum 3 and a main charger 4 to have a toner image transferred thereonto. Thereafter, the image is fixed as the paper moves through a fixing section 5. The copy paper discharged from the fixing section 5 passes through a first switch gate 6 and moves toward a second switch gate 7 therebelow.

When the aforementioned second switch gate 7 is set for the two-side copying mode of operation, the copy paper is moved to a direction reversing section 8. The direction reversing section 8 serves to reverse the direction of motion of the incoming copy paper by alternately activating positive-rotating rollers 9 and negative-rotating rollers 10 and also by switching the direction of a movable paper guide 11 such that the back edge of the copy paper now becomes its front edge as the paper reaches a multi-gate section 12. The back side of the paper which has not been processed by the first copying cycle is now going to be exposed for copying.

The multi-gate section 12 is comprised of a plurality of gates 12*a*, 12*b*, 12*c*. . . arranged in the direction of motion of the copy paper. The gate corresponding to the size of the paper is opened and the paper drops into what is herein referred to as an intermediate tray 13. The paper which has been dropped into this intermediate tray 13 keeps traveling forward by the action of rollers 14 inside the multi-gate section 12 until its back edge leaves the multi-gate section 12. Its top edge advances on the intermediate tray 13 or the sheets of copy paper already piled up thereon. After it leaves the multi-gate section 12, the copy paper is transported to a front edge aligning roller 15 and is set at a specified position with its front edge in contact with a paper refeeding gate 16 at the front end of the intermediate tray 13. Thereafter, its transverse position is adjusted by means of an aligning plate (not shown) and the paper is then ready to be fed again for the processing of its second side.

After all copy paper sheets which have had images transferred onto one side only are stacked in the intermediate tray 13, the refeeding gate 16 is opened by a signal indicating that the processing of the second sides is to start. The sheets of copy paper in the intermediate tray 13 are sequentially transported one by one from the top to the aforementioned paper feeder rollers 2 through a refeeding inlet 18 by the operation of refeeding rollers 17.

What was described above is the automatic two-side copying mode of operation. When the composite copying mode of operation is desired, the aforementioned second switch gate 7 is opened in the direction of the multi-gate section 12 such that the copy paper with image transferred only to one side thereof is passed directly to the multi-gate section 12 without going through the aforementioned direction reversing section 9. The motion of the paper thereafter is the same as described above and composite images are automatically produced on one side of the paper.

With a copying machine of the type having such an intermediate tray, a jam may take place between the multi-gate section 12 and the intermediate tray 13. For this reason, it is preferable to equip the copying machine with a mechanism for detecting such a jam. One of the typical methods previously considered was to place a movable piece in the path of the paper such that the passing of a sheet of paper can be detected by the laid-down position of this movable piece. Another method was to provide an optical sensor from the top surface to the bottom surface of the paper on the intermediate tray 13 such that presence or absence of paper can be detected optically. Presence or absence of a jam can be detected by checking whether this sensor is in the ON condition or not after a specified time interval. With such previously considered mechanisms for detecting a jam, however, a jam of the type caused by a copy paper sheet which curls up and becomes wrinkled into an accordion-like shape cannot be detected because such a wrinkled sheet can still knock down the movable piece in its path to a laid-down position. An optical sensor is not effective in such a situation, especially when there are many sheets stacked in the intermedite tray 13.

SUMMARY OF THE INVENTION

It is therefore an object of the present invention to provide a detector which can effectively detect a jam in the intermediate tray section of a copying machine.

The above and other objects of the present invention are achieved by providing a jam detector with an optical system which makes use of a light beam traveling the entire length of the path of the copy paper along the intermediate tray.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1A:
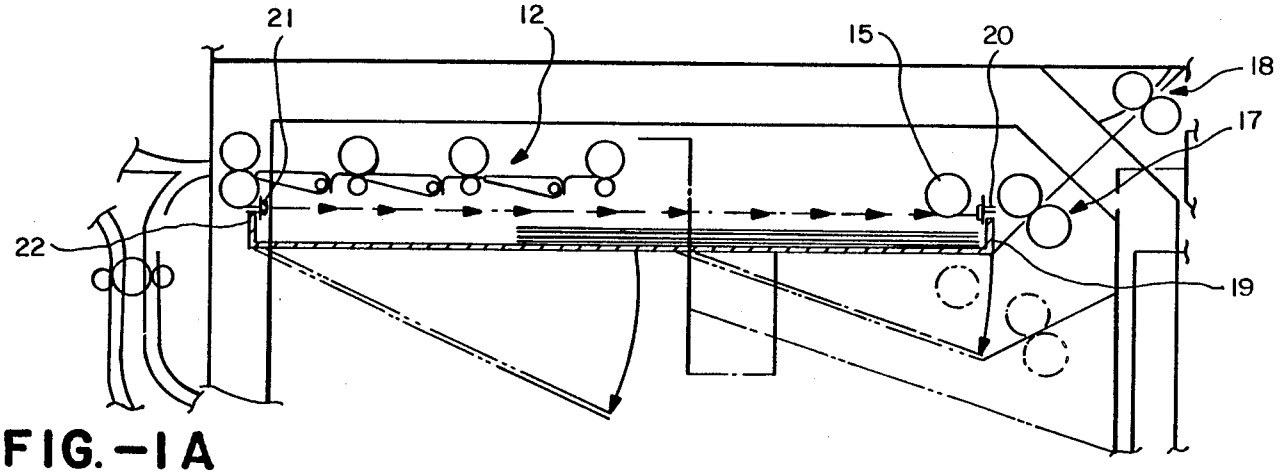
FIG. 1A is a schematic side-sectional view and FIG. 1B is a schematic plan view of an intermediate tray section of a copying machine equipped with a jam detector embodying the present invention.
Figure 1B:
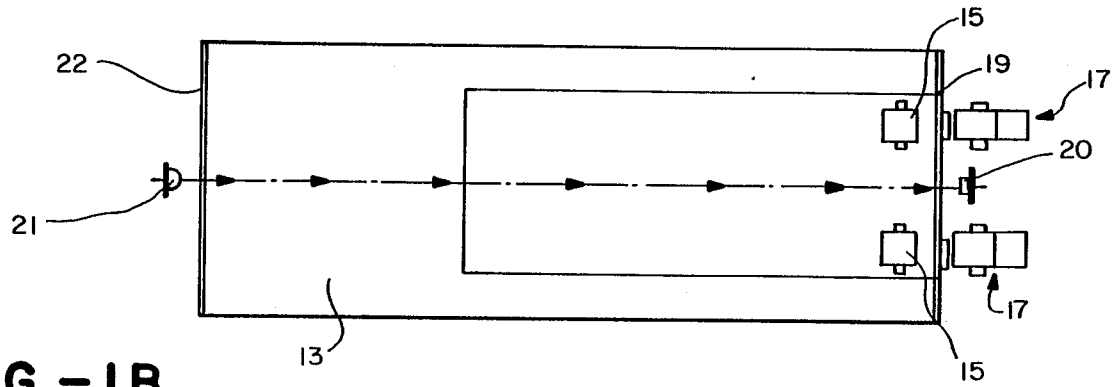
Figure 3:
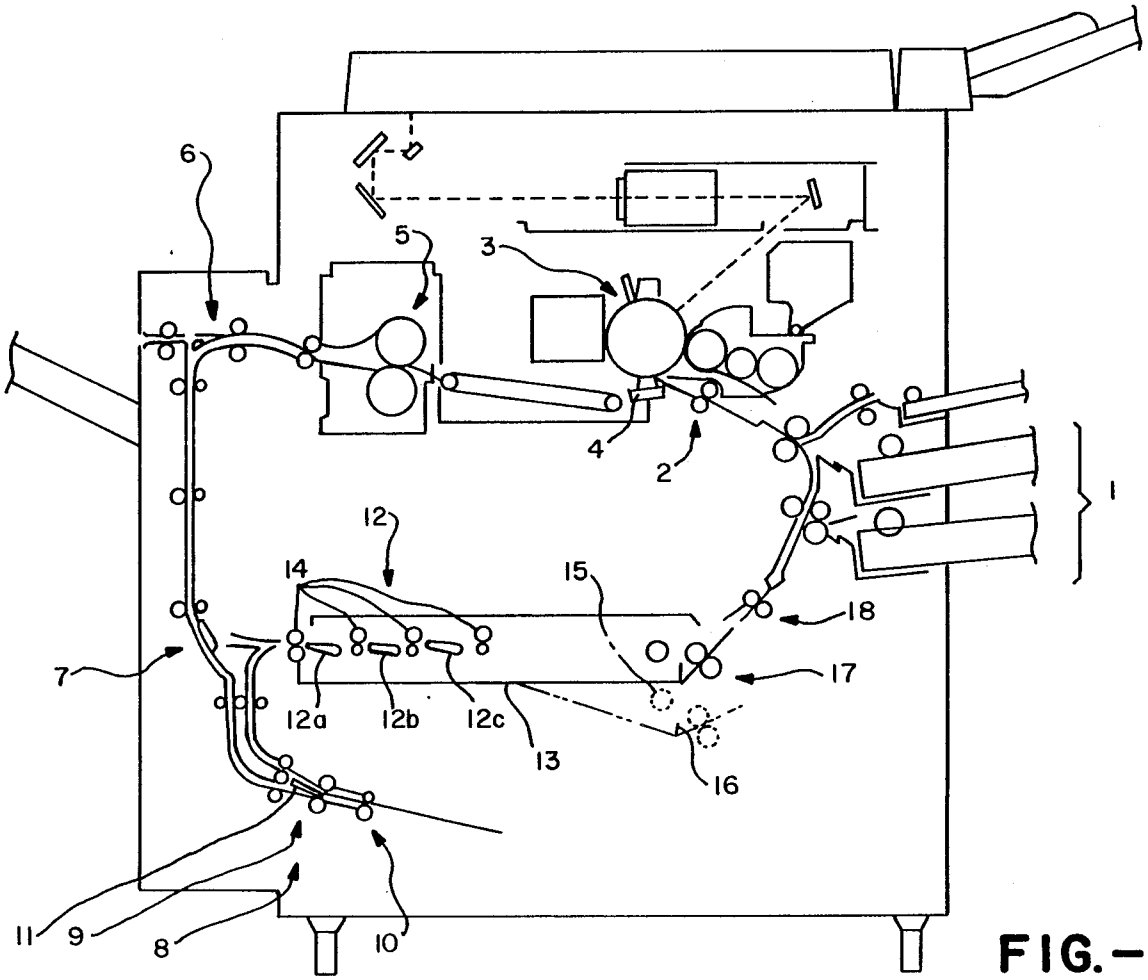
FIG. 3 is a schematic side-sectional view of a copying machine in which a jam detector of the present invention can be incorporated.

With reference to FIGS. 1A and 1B wherein components which are equivalent or identical to those shown in FIG. 3 are indicated by same numerals, there are provided a light receiving element 20 above a front end wall 19 of the intermediate tray 13 and a light emitting element 21 above a back end wall 22 of the intermediate tray 13 such that the light beam from the light emitting element 21 is received by the light receiving element 20. These elements 20 and 21 may be placed on the central longitudinal axis of the intermediate tray 13 as shown in FIG. 1B, or alternatively on a diagonal line. More than one pair of such elements may be ulitized, but they must be above the intermediate tray 13 and light beams provided by them must span the entire length of the intermediate tray 13 at least below the multi-gate section 12 in the direction of motion of the copy paper.

More precisely, the aforementioned optical sensor must be set somewhat higher than the height of the sheets when a maximum allowed number thereof is stacked in the intermediate tray 13 because the natural curling of the stacked paper should be anticipated. Transversely, the light emitting and receiving elements 20 and 21 must be positioned such that a sheet with the minimum expected width can also be detected. In this sense, the transverse positioning shown in FIG. 1B is preferable, if copy paper is aligned at the center.

During the normal copying operation when a sheet of copy paper is falling from the multi-gate section 12 to the intermediate tray 13, that is, from the moment when the front edge of the paper appears from the multi-gate outlet until its back edge leaves the multi-gate section 12 and the paper becomes set at the specified position on the intermediate tray 13, the light emitted from the light emitting element 21 is obstructed by this falling paper and does not reach the light receiving element 20. In other words, the sensor signal during this period becomes OFF. Since this happens every time a sheet of copy paper is transported, pulse signals at fixed intervals corresponding to the size of the copy paper are transmitted to a jam detection circuit during a normal operation period.

Figure 2A:
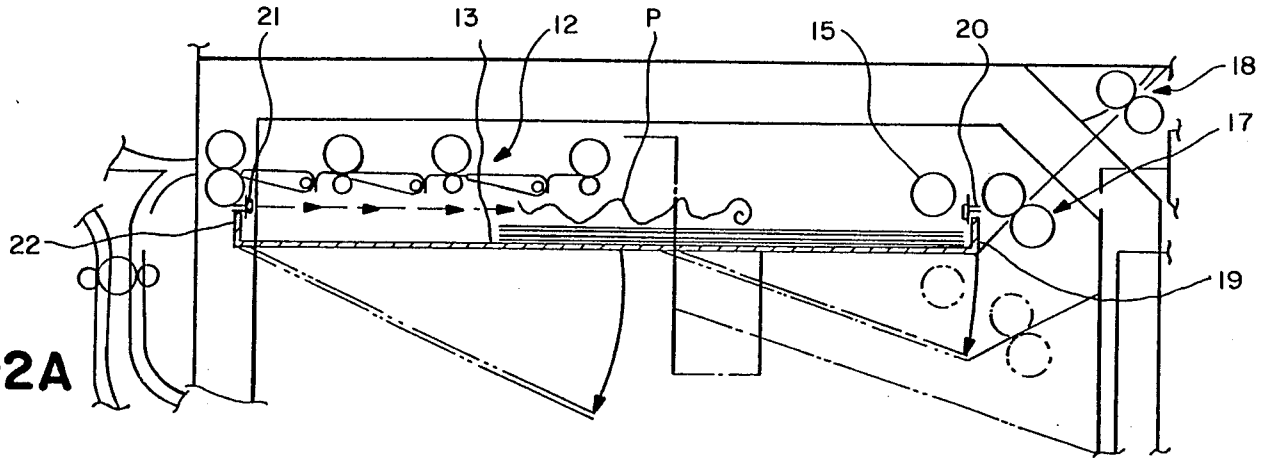
FIGS. 2A and 2B are each a schematic side-sectional view of the intermediate tray section of FIG. 1A when there is a jam.
Figure 2B:
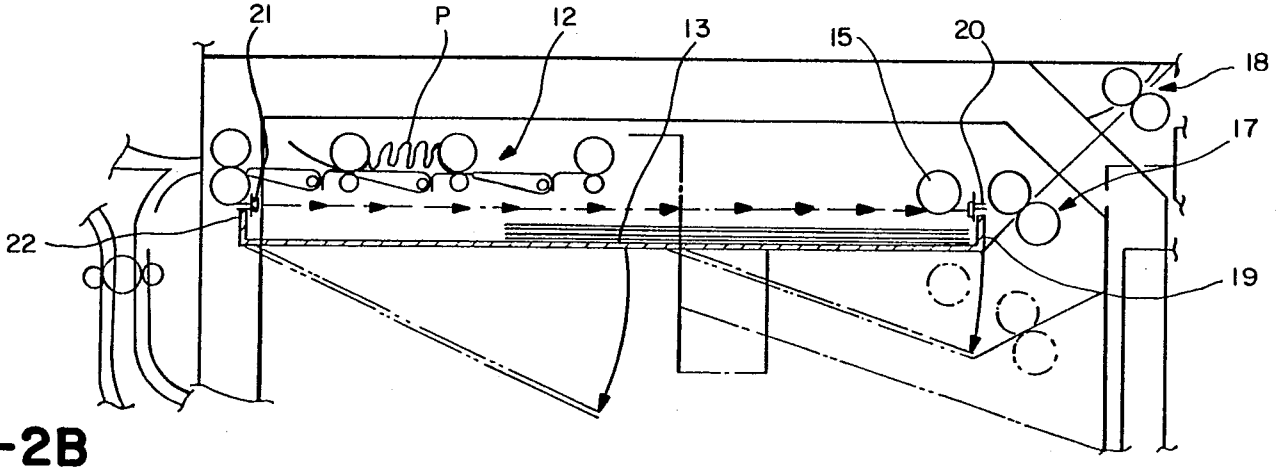

If a jam takes place above the intermediate tray 13 as shown in FIG. 2A, for example, with a sheet of copy paper curling up or bending in an accordion-like manner, the signal from the light receiving element 20 continues to be OFF. This indicates the occurrence of a jam immediately above the intermediate tray 13. If a jam occurs instead in the multi-gate section 12 as shown in FIG. 2B, the signal from the light receiving element 20 remains in the ON condition after the sheet immediately before the jammed one drops onto the intermediate tray 13. In other words, the signal does not go off even after the predetermined cyclic period as anticipated. This indicates the occurrence of a jam in the multi-gate section 12.

In summary, the present invention discloses a jam detector for the intermediate tray section of a copying machine. The jam detector is in the form of an optical system and a jam is detected when the beam passed by this optical system fails to be obstructed at regular intervals determined by the size of the copy paper being used and dropped from above into the intermediate tray.

What is claimed is:

1. In a copying machine having an intermediate tray for temporarily supporting copy paper after one side thereof has been subjected to image transferring proces until said paper is transported again to a paper feeding section of said copying machine, the improvement wherein said coping machine further comprises a jam detector with an optical system adapted to pass a light beam along the entire length of said intermediate tray in the direction of motion of said copy paper.

2. The copying machine of claim 1 wherein said optical system includes a light emitting element and a light receiving element which receives light from said light emitting element.

3. The copying machine of claim 2 wherein said light emitting element and light rceiving element are placed above said intermediate ray at a height greater than the maximum thickness of copy paper sheets allowed to be placed on said intermediate tray.

4. The copying machine of claim 2 wherein said light emitting element and light receiving element are placed below a means for dropping said copy paper into said intermediate tray such that a sheet dropped from said dropping means obstructs said beam.

5. The copying machine of claim 4 wherein said dropping means is of a multi-gate structure.

6. The copying machine of claim 2 wherein said light emitting element is adapted to emit said light beam parallel to said direction of motion of said copy paper.

7. The copying machine of claim 6 wherein said light beam travels at the middle of the width of said intermediate tray.

8. The copying machine of claim 1 wherein said optical system includes more than one light emitting element and light receiving element.

* * * * *